US009091085B2

(12) United States Patent
Hokanson

(10) Patent No.: US 9,091,085 B2
(45) Date of Patent: Jul. 28, 2015

(54) DOORFRAME JIG AND METHOD

(76) Inventor: Don C. Hokanson, Bountiful, UT (US)

( * ) Notice: Subject to any disclaimer, the term of this patent is extended or adjusted under 35 U.S.C. 154(b) by 0 days.

(21) Appl. No.: 13/356,604

(22) Filed: Jan. 23, 2012

(65) Prior Publication Data

US 2013/0186037 A1 Jul. 25, 2013

(51) Int. Cl.
*E04F 21/00* (2006.01)

(52) U.S. Cl.
CPC ..... *E04F 21/0015* (2013.01)

(58) Field of Classification Search
USPC ..... 33/194, 197, 562, 613, 645
See application file for complete search history.

(56) References Cited

U.S. PATENT DOCUMENTS 3,059,341 A 10/1962 Becker
3,753,556 A 8/1973 Nix
4,707,925 A * 11/1987 Englehart ..... 33/194
5,167,073 A 12/1992 Stein
5,560,112 A * 10/1996 Stein et al. ..... 33/194
6,237,233 B1 * 5/2001 Cloutier et al. ..... 33/194
6,282,852 B1 * 9/2001 Walcker ..... 33/194
6,810,592 B1 11/2004 Oldfied
6,966,119 B1 * 11/2005 Dlugoleski ..... 33/194
2003/0204961 A1 * 11/2003 Sumner ..... 33/194
2004/0000061 A1 * 1/2004 Tuthill ..... 33/194
2007/0079521 A1 * 4/2007 Hill ..... 33/809

* cited by examiner

*Primary Examiner* — G. Bradley Bennett
(74) *Attorney, Agent, or Firm* — Steven Rinehart

(57) ABSTRACT

A portable doorframe installation jig is disclosed, adapted to allow a construction worker to readily install a new doorframe plum, level, and in plane. It also may be used as a brace to retain doorframe position during installation of framing and/or drywall. It may also be used as a reinspection tool after installation of drywall. The door jig further serves the purpose of stabilizing the doorframe, in some embodiments, during construction.

15 Claims, 4 Drawing Sheets

DOORFRAME JIG AND METHOD

BACKGROUND OF THE INVENTION

1. Field of the Invention

This invention relates to construction tools, and more particularly relates to a jig for installing properly dimensioned doorframes and for maintaining the integrity of a doorframe during construction of fixtures proximate to the doorframe.

2. Description of the Related Art

Doorframes and door jambs are well-known in the art. Typically, in most residential and commercial settings, doorframes, for mounting hinged doors, comprise wooden frames or hollow metal frames including the following principal components: a head jamb (constituting a horizontal member above the recess and below the lintel); jambs (constituting vertical members laterally defining the recess meant to house the door), and a sill (constituting a horizontal member below the recess designed to house the door). The head jamb, jambs, and sill may rest on or above concrete, metal, and/or wood structural components of a wall, building, bulkhead, etc.

Typically, in residential and commercial construction projects, doorframes are created with stamped light gauge metal components of various widths (or other wooden components well known to those of skill in the art) during the framing phase in construction, which precedes the finishing phase. The wooden components are affixed together using nails, screws, gusset plates 111, and the like, while the metal components may be welded, screwed or bolted.

While construction workers are careful during framing to define door recesses of exact dimensions called for by plans, blue prints, and the like, the framing is never completely rigid or stable until construction is finished. As the framing phase progresses, some framing components are strained through tensile and/or compressive forces, which often alter the dimensions of, squareness, and/or parallelism of, the jambs or other components in the walls including the doorframe.

The doorframe installation process can be tedious. Components must be precisely measured and assembled, and there exists no efficient guides in the art for use in installing doorframes.

Even when the finishing phase is in progress, drywall (i.e. gypsum board) being affixed to the framing components can strain framing and alter the dimensions of the doorframe, ultimately warping the doorframe such that doors created to standard or specified dimensions do not fit in the doorframe after finishing, or align properly with the frame. Doors installed in misformed frames may have non-uniform spacing between the door and the jambs. A properly installed door should touch the frame uniformly across the side of the door comprises the latch.

Current methods and apparatii do not readily facilitate a quick method for properly securing, stabilizing and readying a doorframe for installation. It is therefore desirable that a portable, stable tool be provided which can be used by construction crews to install a doorframe, and which can secure and stabilize a doorframe after its components are affixed together such that the doorframe remains properly in position during subsequently construction.

SUMMARY OF THE INVENTION

From the foregoing discussion, it should be apparent that a need exists for a doorframe installation tool. Beneficially, such an apparatus would overcome many of the difficulties with prior art by providing a means for properly installing and verifying newly installed doorframes.

The present invention has been developed in response to the present state of the art, and in particular, in response to the problems and needs in the art that have not yet been fully solved by currently available apparatii and methods. Accordingly, the present invention has been developed to provide a doorframe jig comprising a generally rectangular frame comprising: an elongated upper member between 0.2 meters and 5 meters in length, for abutting a head jamb, the upper member formed from a rigid substance, the upper member permanently affixed to one or more of a right lateral member and a left lateral member; an elongated lower member, for abutting a sill, between 0.2 meters and 5 meters in length, the lower member formed from a rigid substance, the lower member permanently affixed to one or more of the right lateral member and the left lateral member.

The jig comprises the right lateral member is for abutting a door jamb, wherein the right lateral member is permanently disposed within the frame in generally parallel orientation to the left lateral member, the right lateral member permanently affixed to the upper member at an angle of between 60 and 110 degrees, the right lateral member permanently affixed to the lower member at an angle of between 60 and 110 degrees.

The jig comprises the left lateral member, for abutting a door jamb, wherein the left lateral member is generally parallel orientation to the right lateral member, the left lateral member permanently affixed to the upper member at an angle of between 60 and 110 degrees, the left lateral member permanently affixed to the rear member at an angle of between 60 and 110 degrees.

The doorframe jig may further comprise a plurality of handles detachably affixed to one or more of the right lateral member and the left lateral member using one of bolts, screws, brackets, and welded joint(s).

The doorframe jig may further comprise a second generally rectangular frame hingedly affixed to the rectangular frame, the length of the second rectangular frame added to the length of the rectangular frame equally the length of standard door.

The jig may further comprise one or more elongated crossbeam(s), formed from a rigid substance, each crossbeam affixed at one end to a point of intersection between two or more of the upper member, the lower member, the left lateral member and the right lateral member, and affixed at an opposing end to one or more of the upper member, the lower member, the left lateral member and the right lateral member.

The jig further may also further comprise a girder, formed from a rigid substance, affixed at one end to the right lateral member and affixed at an opposing end to the left lateral member.

The members may comprise elongated, hollow metal tubes. In some embodiments, the members comprise one of bar stock, angle iron beams, pipe, I-shaped beams, H-shaped beams, tubes, and U-shaped beams.

Alternatively, the members may comprise a number of holes drilled through the members for securing the doorframe jig to one of clamps and braces detachably affixable to a doorframe.

In some embodiments, each of the right lateral member, left lateral member, lower member, and upper member are affixed with one or more gusset plate(s) to the jig.

The doorframe jig may further comprise a plurality of handles affixed to one or more of the right lateral member and the left lateral member.

A second embodiment of a doorframe jig is disclosed which comprises a generally triangular truss comprising: an elongated first crossbeam between 0.2 meters and 5 meters in length, the first crossbeam formed from a rigid substance, the first crossbeam permanently affixed at opposing ends to a lateral member and a second crossbeam; and an elongated second crossbeam, between 0.2 meters and 5 meters in length, the second crossbeam formed from a rigid substance, the second crossbeam permanently affixed to one or more of the lateral member and the first crossbeam.

The truss further comprises the lateral member, for abutting a door jamb, wherein the lateral member is permanently affixed to both the first crossbeam and to the second crossbeam at respective angles of between 30 and 120 degrees.

The second doorframe jig also comprises an elongated upper member between 0.2 meters and 5 meters in length, for abutting a head jamb, the upper member formed from a rigid substance, the upper member permanently affixed the lateral member and a second lateral member; and an elongated lower member, for abutting a sill, between 0.2 meters and 5 meters in length, the lower member formed from a rigid substance, the lower member permanently affixed to the lateral member and a second lateral member.

The second doorframe jig also comprises the second lateral member, for abutting a door jamb, wherein the right lateral member is oriented parallel to the lateral member, the second lateral member permanently affixed to the upper member at an angle of between 60 and 110 degrees, and the right lateral member permanently affixed to the lower member at an angle of between 60 and 110 degrees.

A method of installing a doorframe during construction is also disclosed, the method comprising: temporarily inserting a generally rectangular doorframe jig into the doorframe to maintain the integrity of the doorframe dimensions during installation to ensure the doorframe stays in the proper position; wherein the rectangular doorframe jig is approximately identical in dimensions of width and height to a recess defined by the doorframe, the recess for receiving a door, wherein the doorframe jig abuts all of the head jamb, sill, and door jambs; inserting the jig into the doorframe to confirm alignment of the sill, head jamb, and door jambs; removing the jig; drywalling the building; positioning the rectangular jig in the doorframe during drywalling of the building to confirm the doorframe is in the proper position and of the proper dimensions after drywalling.

The temporarily inserted rectangular frame may further abut a doorstop of the doorframe. The method may further comprise temporarily inserting a second generally rectangular frame into the doorframe for additional support, the rectangular frame forming part of the doorframe jig.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Figure 1A:
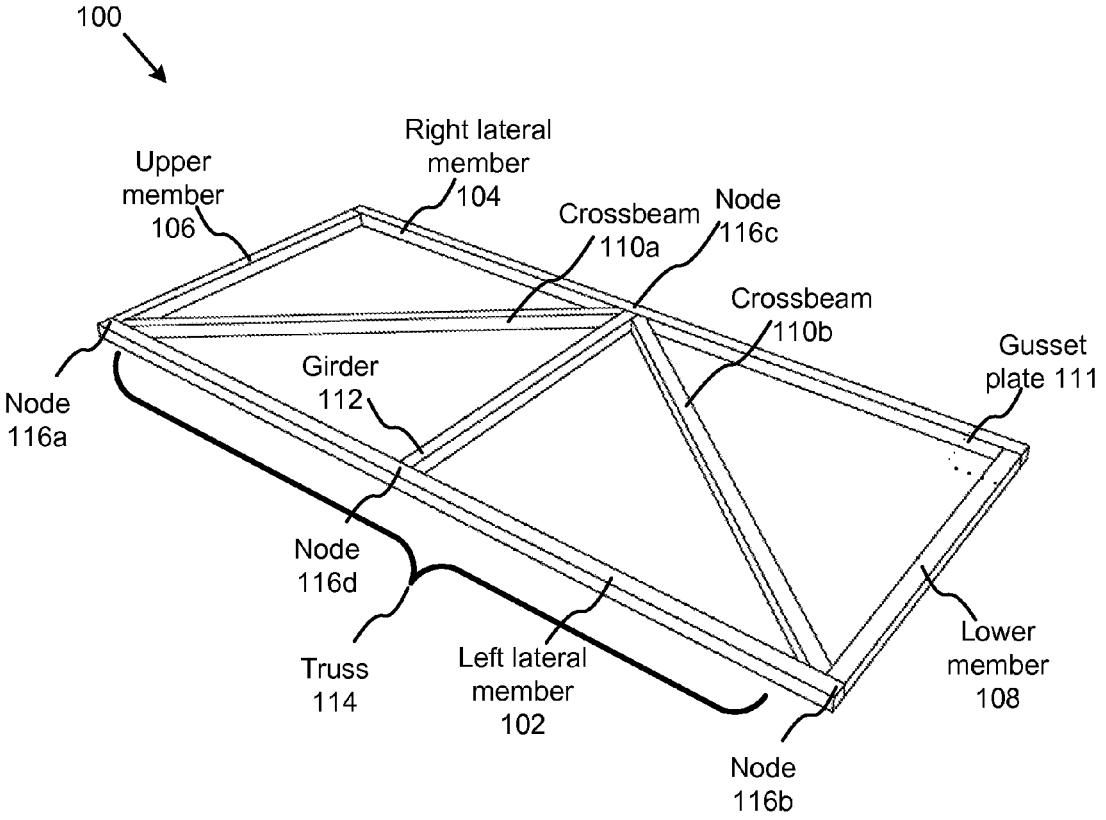
FIG. 1A is a side elevational perspective view a doorframe jig in accordance with the present invention.

FIG. 1A is a side elevational perspective view a doorframe jig 100 in accordance with the present invention. The doorframe jig 100 unit comprises a left lateral member 102, a right lateral member 104, an upper member 106, a lower member 108, a crossbeam 110*a*, a crossbeam 110*b*, a gusset plate 111, a girder 112, a truss 114, a node 116*a*, a node 116*b*, a node 116*c*, and a node 116*d*.

In the shown embodiment, the left lateral member 102, the right lateral member 104, the upper lateral member 106, and the lower member 108 are affixed, or welded to one another, at generally right angles between 80 and 100 degrees (each of the left lateral member 102, the right lateral member 104, the upper lateral member 106, the lower member 108, the crossbeams 110*a-b*, and the girder 114 are collectively referred to herein after as the "members 102-112"). The members 102-112 may be affixed together using nails, screws, welded joints, gusset plates 111, bolts, and the like.

Each of the members 102-112, in the shown embodiment, comprise elongated, hollow metal tubes. Each of the members 102-112 may alternatively comprise rods, beams, plates, bar stock, angle, or pipe(s). Each of the members 102-112 may alternatively comprise cubic-shaped polymer housings. Each of the members 102-112 may alternatively comprise I-shaped, H-shaped, or U-shaped beams. The members 102-112 may comprise square- or rectangular-shaped tubing through the members' 102-112 cross-section. The members 102-1126 may comprise a number of holes, bores, or apertures drilled through the members 102-112 for securing the doorframe jig 100 to the clamps or braces.

The members 102-112 may be manufactured from polymers, wood, metals, alloys, aluminum, magnesium, titanium, carbon-fiber, and the like.

The left lateral member 102, the girder 112, the crossbeam 110*a* and the crossbeam 110*b* collectively form the truss 114 of the doorframe jig 100. The truss 114 is designed to withstand tensile and compressive forces imposed upon the doorframe jig 100 by the building structure as it is improved through subsequent construction. In the shown embodiment, the truss 114 is triangular rectangular from a top perspective view. In alternative embodiments, the truss 114, from this perspective, may be circular, elliptical, triangular, polygonal, or otherwise.

In some embodiments, the upper member 106, the lower member 108, and/or the girder 112 comprise a level integrated into, above, or beneath said member, for use in leveling the doorframe jig 100 and corresponding doorframe. In some embodiments, the level is detachably affixed to one of the members 102-112. In some embodiments, one or more of the members 102-112 comprises one or more magnets or plates for securing the level. In many embodiments, the members 102, 104, 106, 108 are affixed at right angles (i.e. 90 degree angles) to one another.

In some embodiments of the present invention, the doorframe jig 100 comprises two trusses 114. The trusses may have opposed left lateral members 102. The trusses may overlay one another, or may meet at a node 116 in the middle of the doorframe jig 100.

FIG. 1A shows a plurality of nodes 116, each node 116 representing an intersection point of two or more members 102-112. For instance, node 116*a* represents the intersection point of the upper member 106, the left lateral member 102 and the crossbeam 110*a*. In the shown embodiments, these said members 102, 106, 110*a* are welded together at node 116*a*. Likewise, nodes 116*b*, 116*c*, and 116*d* each respectively represent the intersection of various other members 102-112.

Gusset plates 111 may overlay the nodes 116*a-d* to add additional stability to the doorframe jig 100. The gusset plates 111 and/or members 102, 104, 106, 108 may be labeled with information about the doorframe jig size and dimensions. The left lateral member 102, the right later member 104, the upper member 106, and the lower member 108 may each comprise one or more handles, know to those of skill in the art, for transporting and positioning the doorframe jig 100. The handles may be permanently affixed to the doorframe jig, or detachable.

As construction progresses after the doorframe is constructed, the subsequent construction tends to warp, contort, or strain the doorframe, and pressure is exerted principally at the nodes 116*a-d*. For this reason, the nodes 116 are reinforced with various member 102-112 traveling in a plurality of directions across the x- and z-axes of the doorframe jig 100.

In some embodiments of the present invention, additional crossbeam(s) 110 run from the intersection of the upper member 106 and the right lateral member 104 to node 116*d* or to the midsection of the crossbeam 110*a*.

Likewise, in some embodiments of the present invention, additional crossbeam(s) 110 run from the intersection of the lower member 108 and the right lateral member 104 to node 116*d* or to the midsection of the crossbeam 110*b*.

The width and length of the doorframe jig 100 may be conformed to specific dimensions of standard doors, such as 36×84 inches, and the like, or to specially sized doors of non-standard dimensions.

In some embodiments of the present invention, the doorframe jig 100 is inserted into framing before the doorframe is constructed around it. In this manner, the doorframe jig 100 serves not only to stabilize the doorframe during finishing and after construction, but also to serve as guide during installation of the doorframe itself.

Figure 1B:
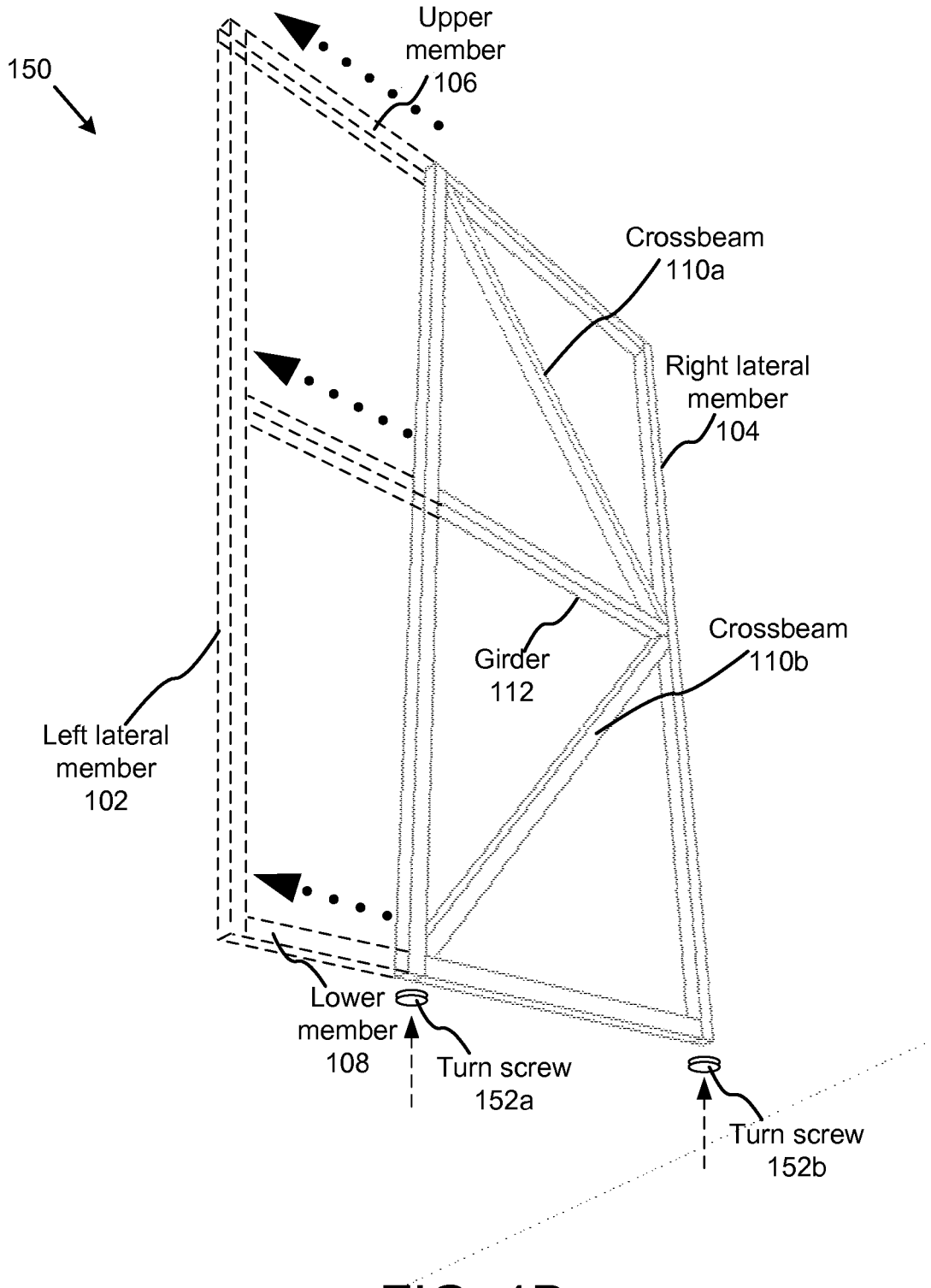
FIG. 1B is a lower elevational perspective view of another embodiment of a doorframe jig in accordance with the present invention.

FIG. 1B is a lower elevational perspective view of another embodiment of a doorframe jig 150 in accordance with the present invention. The doorframe jig 150 comprises a left lateral member 102, a right lateral member 104, an upper member 106, a crossbeam 110*a*, a crossbeam 110*b*, a girder 112, a turnscrew 152*a*, and a turnscrew 152*b*.

In the shown embodiment, the girder 112, the upper member 106 and the lower member 108 are telescopic. Each can be adjusted laterally using means known to those of skill in the art to change the width of the doorframe jig 150. In some embodiments, the doorframe jig 150 can additionally or alternatively be adjusted vertically (i.e. longitudinally) to change the length or height of the doorframe jig 150.

The girder 112, upper member 106 and lower member 108 may each comprise an inner sleeve affixed to the left lateral member 102 such that the left lateral member 102 slides out laterally away (with the inner sleeves) from the remaining body of doorframe jig 150.

In some embodiments, the upper member 106, girder 112 and lower member 108 are drilled with holes at predetermined distances for interlocking the doorframe jig 150 at different size increments using a cotter pin, r-clip, or clevis pin, and/or a hitch pin inserted through the drilled holes (for securing the inner sleeves and width of the doorframe jig 150).

The turnscrews 152*a-b*, in the shown embodiment, are affixed to the base of the lower member 108. These turnscrews 152*a-b* can be manually adjusted to raise or lower the doorframe jig 150 within the doorframe, or adjusted prior to installing or constructing the doorframe to change the height and assist in holding the doorframe level.

In some embodiments, the doorframe jig is designed to fold in one or more places. In those embodiments, one or more of the members 102-112 is divided into two "halves" which are hingedly connected together such that the entire doorframe jig 150 folds over and is more easily transportable.

In other embodiments, the doorframe jig 150 additionally or alternatively comprises clamps for gripping the sides of the doorframe during or after installation and/or construction. These clamps may be affixed to any of the members 102-112.

Figure 1C:
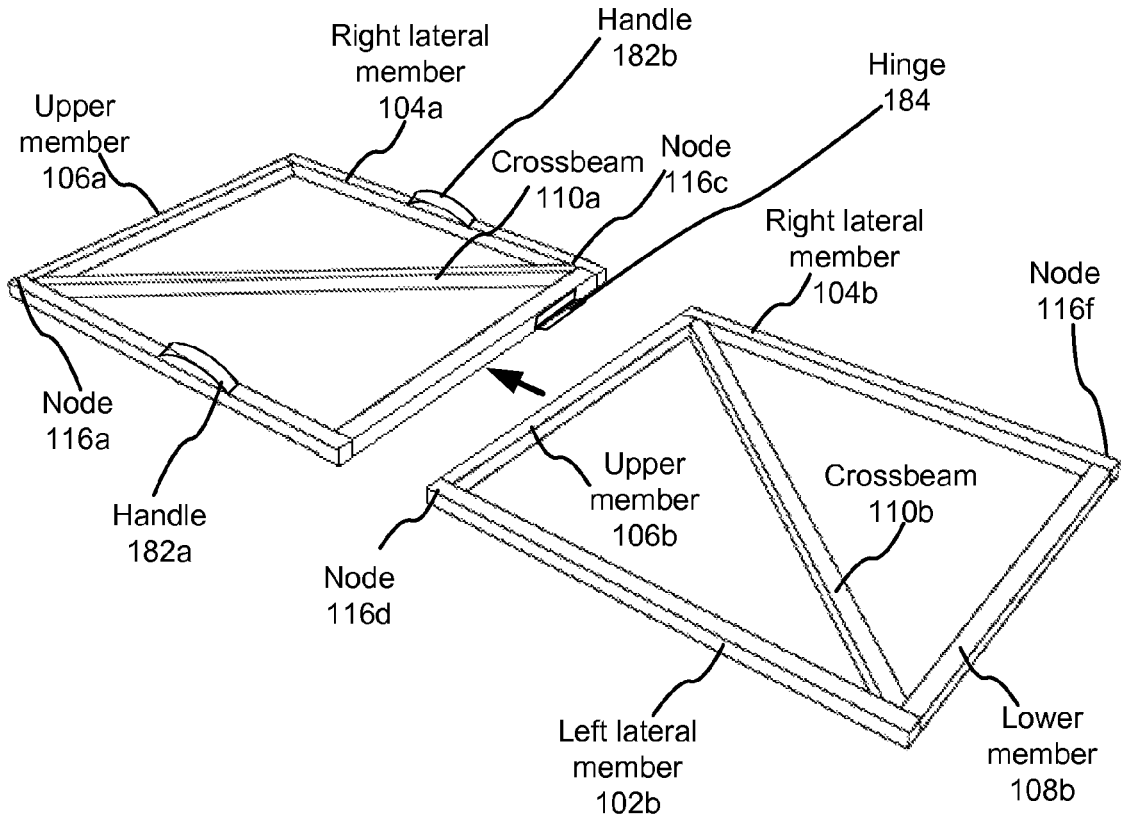
FIG. 1C is an upper elevational perspective view of another embodiment of a doorframe jig in accordance with the present invention.

FIG. 1C is an upper elevational perspective view of another embodiment of a doorframe jig 180 in accordance with the present invention. The jig 180 comprises two independently manufactured sections, an upper section and a lower section, each section comprising an upper member 106, a right lateral member 104, a left lateral member 102, a crossbeam, and a lower member 108. The upper section additionally comprises two handles 182*a-b* and a hinge 184. The corners of each section comprises nodes 116.

In various embodiments, the upper section and lower section are welded or affixed together using bolts, brackets, screws, or via other means known to those of skill in the art. In some embodiments, spacers may be affixed between the upper and lower sections, permanently or detachably, to change the length of the jig 180 in assembled form. In other embodiments, the upper and lower sections are hingedly connected with one or more hinges 184 to allow the sections to fold over one another to facilitate ease of transport.

Figure 2:
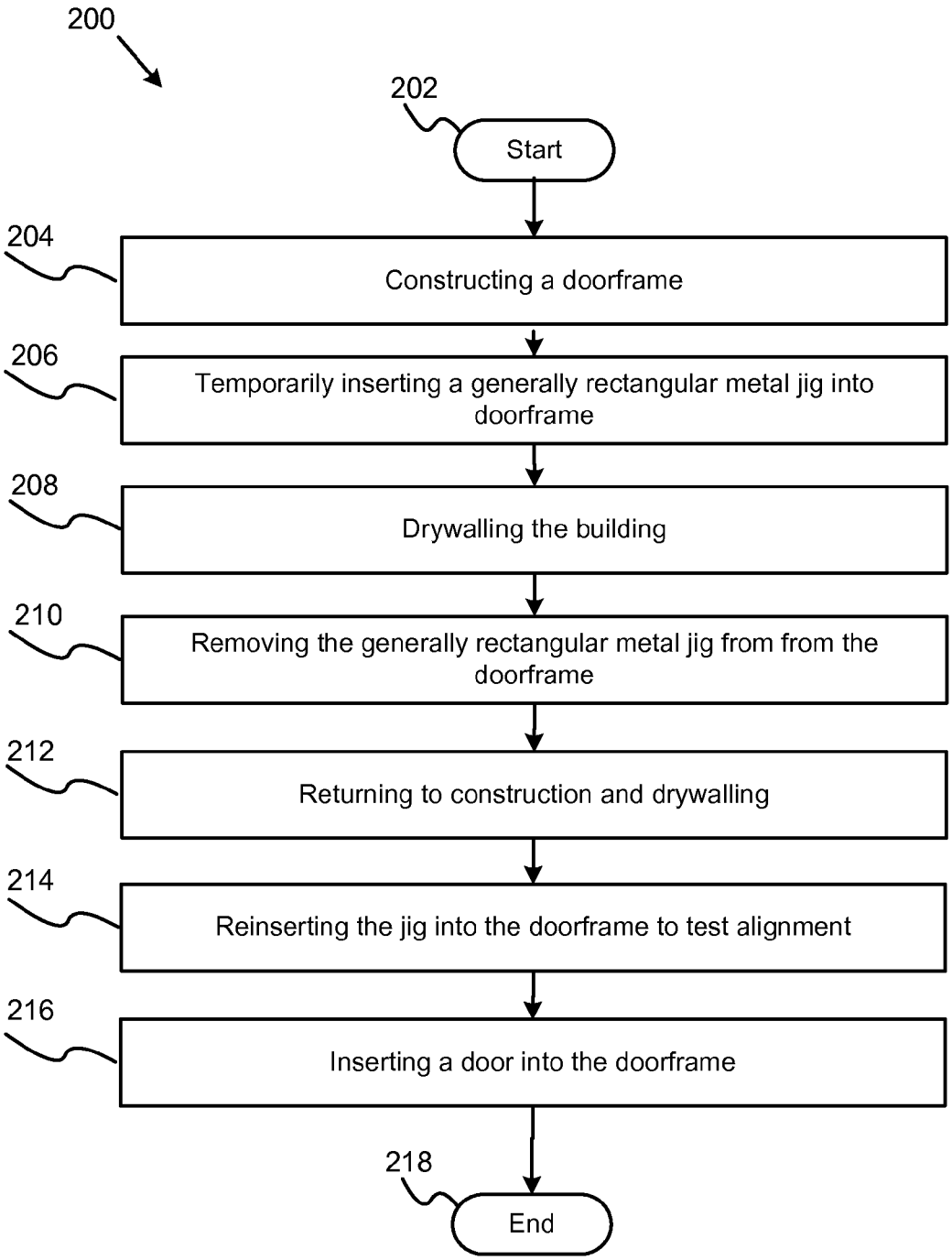
FIG. 2 is a process flow chart of a method of stabilizing a doorframe in accordance with the present invention.

FIG. 2 is a process flow chart of a method 200 of stabilizing a doorframe in accordance with the present invention.

The method 200 begins 202 with the installation (e.g. construction) 204 of a doorframe in a residential or commercial building using means well-known to those of skill in the art, including standard wood or metal framing techniques. During the framing phase, the doorframes are installed with a head jamb, sill, and two door jambs. The framing structure of the building being constructed is then drywalled, or fitted with gypsum board, paneling, plywood, or the like. During the drywall phase, drywall is attached to the framing, usually with nails, or screws and using techniques well-known to those of skill in the art. In some embodiments, gypsum board, paneling or plywood is affixed to the framing.

Finally, after the drywall is installed, the metal frame or jig is inserted 210 into the doorframe to again confirm that the frame had not moved during the installation of the drywall. This will allow a door of predetermined dimensions to be inserted 212 into the doorframe with proper clearances and fit. The rectangular metal frame inserted into the doorframe may comprise the doorframe jig 100 further described above in relation to FIG. 1. The rectangular metal frame may comprise a plurality of beams, girders 112, and crossbeams 110 as necessary to withstand the compressive and/or tensile forces exerted upon the doorframe during drywalling and during subsequent framing construction.

In many embodiments, the doorframe is constructed around a metallic, rectangular doorframe jig which is mounted in place before doorframe construction. The doorframe jig may be mounted on a wooden or concrete constructed surface using nails, clamps, lashing, or compressive forces from structural components adjoining the mounted doorframe jig. Alternatively, the doorframe jig may be mounted to framing components in the structure, such as 2×4s.

In some embodiments of the present invention, the doorframe jig 100 is left in the doorframe from the time installation of the doorframe begins until construction on the wall is finished. The jig 100 may be repeatedly reinserted 214 into the doorframe to test the alignment of the components 102, 104, 106, 108. Finally, after construction is complete, a door is inserted 216 into the doorframe.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A doorframe jig comprising:

a generally rectangular frame comprising:

an elongated upper member between 0.2 meters and 5 meters in length, for abutting a head jamb, the upper member formed from a rigid substance, the upper member permanently affixed to one or more of a right lateral member and a left lateral member;

an elongated lower member, for abutting a sill, between 0.2 meters and 5 meters in length, the lower member formed from a rigid substance, the lower member permanently affixed to one or more of the right lateral member and the left lateral member;

the right lateral member, for abutting a door jamb, wherein the right lateral member is permanently disposed within the frame in generally parallel orientation to the left lateral member, the right lateral member permanently affixed to the upper member at an angle of between 60 and 110 degrees, the right lateral member permanently affixed to the lower member at an angle of between 60 and 110 degrees; and the left lateral member, for abutting a door jamb, wherein the left lateral member is generally parallel orientation to the right lateral member, the left lateral member permanently affixed to the upper member at an angle of between 60 and 110 degrees, the left lateral member permanently affixed to the rear member at an angle of between 60 and 110 degrees.

2. The doorframe jig of claim 1, further comprising:

one or more elongated crossbeam(s), formed from a rigid substance, each crossbeam:

affixed at one end to one of:

a point of intersection between two or more of the upper member, the lower member, the left lateral member and the right lateral member; and to one or more of the upper member, the lower member, the left lateral member and the right lateral member; and a girder, formed from a rigid substance, affixed at one end to the right lateral member and affixed at an opposing end to the left lateral member.

3. The doorframe jig of claim 1, further comprising a plurality of handles detachably affixed to one or more of the right lateral member and the left lateral member using one of bolts, screws, brackets, and welded joint(s).

4. The doorframe jig of claim 1, further comprising a second generally rectangular frame hingedly affixed to the rectangular frame, the length of the second rectangular frame added to the length of the rectangular frame equally the length of standard door.

5. The doorframe jig of claim 1, wherein the doorframe jig is used to stabilize a doorframe before, during and after installation of the doorframe.

6. The doorframe jig of claim 1, wherein the doorframe jig is used as a brace during installation of a doorframe.

7. The doorframe jig of claim 1, wherein the members comprise elongated, hollow metal tubes.

8. The doorframe jig of claim 1, wherein the members comprise one of bar stock, angle iron beams, pipe, I-shaped beams, H-shaped beams, tubes, and U-shaped beams.

9. The doorframe jig of claim 1, wherein the members comprise a number of holes drilled through the members for securing the doorframe jig to one of clamps and braces detachably affixable to a doorframe.

10. The doorframe jig of claim 1, wherein each of the right lateral member, left lateral member, lower member, and upper member are affixed with one or more gusset plate(s) to the jig.

11. The doorframe jig of claim 1, further comprising a plurality of handles affixed to one or more of the right lateral member and the left lateral member.

12. A doorframe jig comprising:

a generally triangular truss comprising:

an elongated first crossbeam between 0.2 meters and 5 meters in length, the first crossbeam formed from a rigid substance, the first crossbeam permanently affixed at opposing ends to a lateral member and a second crossbeam;

an elongated second crossbeam, between 0.2 meters and 5 meters in length, the second crossbeam formed from a rigid substance, the second crossbeam permanently affixed to one or more of the lateral member and the first crossbeam;

the lateral member, for abutting a door jamb, wherein the lateral member is permanently affixed to both the first crossbeam and to the second crossbeam at respective angles of between 30 and 120 degrees;

an elongated upper member between 0.2 meters and 5 meters in length, for abutting a head jamb, the upper member formed from a rigid substance, the upper member permanently affixed the lateral member and a second lateral member;

an elongated lower member, for abutting a sill, between 0.2 meters and 5 meters in length, the lower member formed from a rigid substance, the lower member permanently affixed to the lateral member and a second lateral member; and the second lateral member, for abutting a door jamb, wherein the right lateral member is oriented parallel to the lateral member, the second lateral member permanently affixed to the upper member at an angle of between 60 and 110 degrees, and the right lateral member permanently affixed to the lower member at an angle of between 60 and 110 degrees.

13. A method of installing a doorframe during construction, the method comprising:

temporarily inserting a generally rectangular doorframe jig into the doorframe to maintain the integrity of the doorframe dimensions during installation, wherein the rectangular doorframe jig is approximately identical in dimensions of width and height to a recess defined by the doorframe, the recess for receiving a door, wherein the doorframe jig abuts all of the head jamb, sill, and door jambs;

positioning the rectangular jig in the doorframe of the building to confirm the doorframe is aligned;

removing the jig;

drywalling the building;

positioning the rectangular jig in the doorframe of the building to confirm the doorframe is in the proper position and of the proper dimensions after drywalling; and removing the jig.

14. The method of claim 13, wherein the temporarily inserted rectangular frame further abuts a doorstop of the doorframe.

15. The method of claim 14, further comprising temporarily inserting a second generally rectangular frame into the doorframe for additional support, the rectangular frame forming part of the doorframe jig.

* * * * *